US005700137A

United States Patent [19]

Simonette

[11] Patent Number: 5,700,137

[45] **Date of Patent: *Dec. 23, 1997**

[54] LOW PROFILE POSITIVE DISPLACEMENT PUMP SYSTEM

[75] Inventor: Dallas W. Simonette, Andover, Minn.

[73] Assignee: GP Companies, Inc., Mendota Heights, Minn.

[ * ] Notice: The term of this patent shall not extend beyond the expiration date of Pat. No. 5,556,264.

[21] Appl. No.: 566,569

[22] Filed: Nov. 28, 1995

Related U.S. Application Data

[63] Continuation-in-part of Ser. No. 508,586, Jul. 28, 1995, Pat. No. 5,556,264.

[51] Int. Cl.[6] ..... F04B 17/00

[52] U.S. Cl. ..... 417/364; 417/234; 417/539

[58] Field of Search ..... 417/364, 234, 417/440, 533, 539, 569; 123/198 E

[56] References Cited

U.S. PATENT DOCUMENTS

| | | | |
|---|---|---|---|
| 2,103,861 | 12/1937 | Melcher . | |
| 3,597,119 | 8/1971 | Gratzmuller . | |
| 3,679,328 | 7/1972 | Cattanach . | |
| 4,184,809 | 1/1980 | Kelley . | |
| 4,198,373 | 4/1980 | Kropp et al. . | |
| 4,589,825 | 5/1986 | Schmidt . | |
| 4,800,980 | 1/1989 | Hideo et al. | 180/225 |
| 5,067,654 | 11/1991 | Paige . | |
| 5,086,975 | 2/1992 | Paige . | |
| 5,171,136 | 12/1992 | Pacht . | |
| 5,230,471 | 7/1993 | Berfield . | |
| 5,259,556 | 11/1993 | Paige et al. . | |
| 5,338,162 | 8/1994 | Krarup . | |
| 5,538,402 | 7/1996 | McKenney | 417/234 |
| 5,556,264 | 9/1996 | Simonette | 417/307 |

OTHER PUBLICATIONS

CRC Handbook of Chemistry and Physics, p. B142, 1980.

Modern Plastics Encyclopedia '92, pp. 79–80, Oct. 15, 1991.

Spec sheet for Pumptec, Model 356 Phantwin Series (no date).

Spec sheet for Cat Pumps, Duplex Ceramic Plunger Pump Model 17 (no date).

Spec sheet for General Pump Incorporated Triplex Plunger Pump TT2028GBF (Jul. 1995).

Spec sheet for Interpump Model T3000/T3500 (no date).

Spec sheet for Interpump Sintex ZXR/ZXV (Dec. 1992).

Spec sheet for General Pump Incorporated Formula 99 (Jun. 1995).

Spec sheet for Interpump CleanMatic (Oct. 1994.

*Primary Examiner*—Timothy Thorpe
*Assistant Examiner*—Cheryl J. Tyler
*Attorney, Agent, or Firm*—Craig J. Lervick; Jennifer K. Farrar

[57] ABSTRACT

A low profile positive displacement pump system is disclosed. The pump system includes a gasoline powered engine with a vertically disposed crank shaft. The system also includes a piston pump with at least one horizontally disposed piston, and a pump shaft assembly which mounts onto the crank shaft. A base includes a cavity configured for retaining the pump. The engine mounts directly onto the base, and fixes the orientation of the pump shaft assembly with respect to a driven end of each piston. The pump shaft assembly includes at least one eccentric camming surface for contacting a driven end of the piston and for causing each piston to complete one stroke per revolution of shaft rotation. The base comprises a main body including an upper surface, wherein the upper surface is suitable for mounting directly to a mounting flange of the gasoline powered engine.

18 Claims, 8 Drawing Sheets

34
41
39
30
38
36
16
12
10
32
18
28
20
21
22
40
62
42
24
26

LOW PROFILE POSITIVE DISPLACEMENT PUMP SYSTEM

This is a continuation-in-part of application Ser. No. 08/508,586, filed Jul. 28, 1995, now U.S. Pat. No. 5,556, 264.

BACKGROUND OF THE INVENTION

The present invention relates to positive displacement pumps. In particular, the present invention relates to gasoline powered positive displacement pump systems.

In the commercial market, high pressure, gasoline engine powered pumps are well known. For example, professional industrial painters employ high pressure gas powered pumps, also known as pressure washers, to prepare surfaces prior to painting.

In the consumer market, gasoline-powered high pressure washers are known, but the cost is high, and therefore consumer acceptance has been limited. In an effort to improve consumer acceptance, high pressure pump systems for consumer use have been designed which are driven by means of an electric motor. The electrically driven high pressure pumps have achieved some degree of consumer acceptance because of the lower cost, but have disadvantages.

The use of an electrical chord is cumbersome. The electrical chord must also include a ground fault circuit interrupter and be long enough to meet the safety requirements set forth by the National Electrical Code. If an extension chord is needed, only a heavy duty extension chord may be used due to the high amperes required for the electric motor. Both the ground fault circuit and heavy duty chord increase the cost of the device. Moving the extension chords as well as the water hose when using an electrically driven pressure washer can be a nuisance. The unit may also have to be unplugged, relocated and reconnected when using the pump for a large project. For example, when using an electrically powered pressure washer for washing the siding on a house before painting, it is necessary to reconnect the unit to the power source several times.

Another disadvantage of electrically powered high pressure pumps is limited capacity. The electrical circuits in most homes typically have a 15 amp capacity. The maximum size motor that can run on a 15 amp circuit is 1½ horsepower. A pressure washer equipped with a 1½ hp, 15 amp single phase motor delivers approximately 2 gallons per minute at 1000 pounds per square inch gauge (hereinafter p.s.i.). Gasoline powered pumps are capable of delivering a higher volume of liquid at higher pressures.

In an effort to overcome the disadvantages of electrically powered high pressure pumps, pumps designed for mounting onto a gas-powered engine with a vertically oriented rotational shaft have been developed. A typical gas-powered engine is a 5 horsepower lawn mower engine having a vertically disposed drive shaft which rotates at 3400 revolutions per minute under load. This type of engine is preferred because of its wide availability and relatively low cost.

Because the drive shaft of the gasoline powered engine is vertically oriented, the known pumps developed for coupling to such a shaft have required enough vertical distance between the end of the shaft and the pump base that the resulting unit is very tall and top heavy.

The taller pressure washers have also had limited success in the consumer market. The height and top heaviness of the resulting devices are distinct disadvantages. The product is awkward in appearance, and is unstable on uneven surfaces due to its weight and top heaviness. In addition, the cost of such a device high enough to limit market appeal.

It would be desirable to provide a low cost, low profile high pressure pump driven by a gasoline engine, the engine having a vertically disposed rotational shaft.

SUMMARY OF THE INVENTION

A low profile positive displacement pump for mounting directly to a gasoline powered engine, the engine having a vertically disposed shaft is disclosed. The pump is a piston style pump with a fluid inlet, fluid outlet, at least one bore, at least one plunger and a base. The pump has a vertically oriented drive shaft assembly which is mounted onto the crank shaft of an engine having a vertically positioned rotational shaft. The drive shaft assembly includes at least one eccentric surface for driving the plunger. A base is provided which includes a cavity for retaining the pump housing. The engine mounting flange mounts directly onto an upper surface of the base. The base defines the orientation of each eccentric surface with respect to each driven end of each piston.

Each eccentric camming surface is provided for contacting a first end of the piston and for causing the piston to move in a first direction perpendicular to the central axis of the pump shaft. A spring is positioned in the bore for causing the plunger to move in a second direction opposite the first direction.

An inlet check valve is fluidly connected to the fluid inlet, as well as an outlet check valve. Both are mounted in the pump housing. An unloader valve is mounted in the pump housing and fluidly connected to the fluid inlet and outlet.

A high pressure pump base is disclosed. The device includes a main body including an upper surface, wherein the upper surface is suitable for mounting directly to a mounting flange of a gasoline powered engine having a vertically disposed crankshaft. The main body also includes a central cavity being of a size and shape suitable for retaining a high pressure pump, wherein the cavity prevents movement of the pump body during operation.

A positive displacement pumping system is disclosed. The pumping system includes a gasoline powered engine with a vertically disposed rotational drive shaft. A positive displacement pump is provided which includes at least one horizontally disposed reciprocating piston. A pump shaft assembly is provided which includes a pump shaft having a throughbore which engages the drive shaft. At least one eccentric surface is positioned on the pump shaft. The eccentric surface contacts a driven end of the piston and causes the piston to complete a stroke for each revolution of the pump shaft assembly.

DETAILED DESCRIPTION

Figure 1:
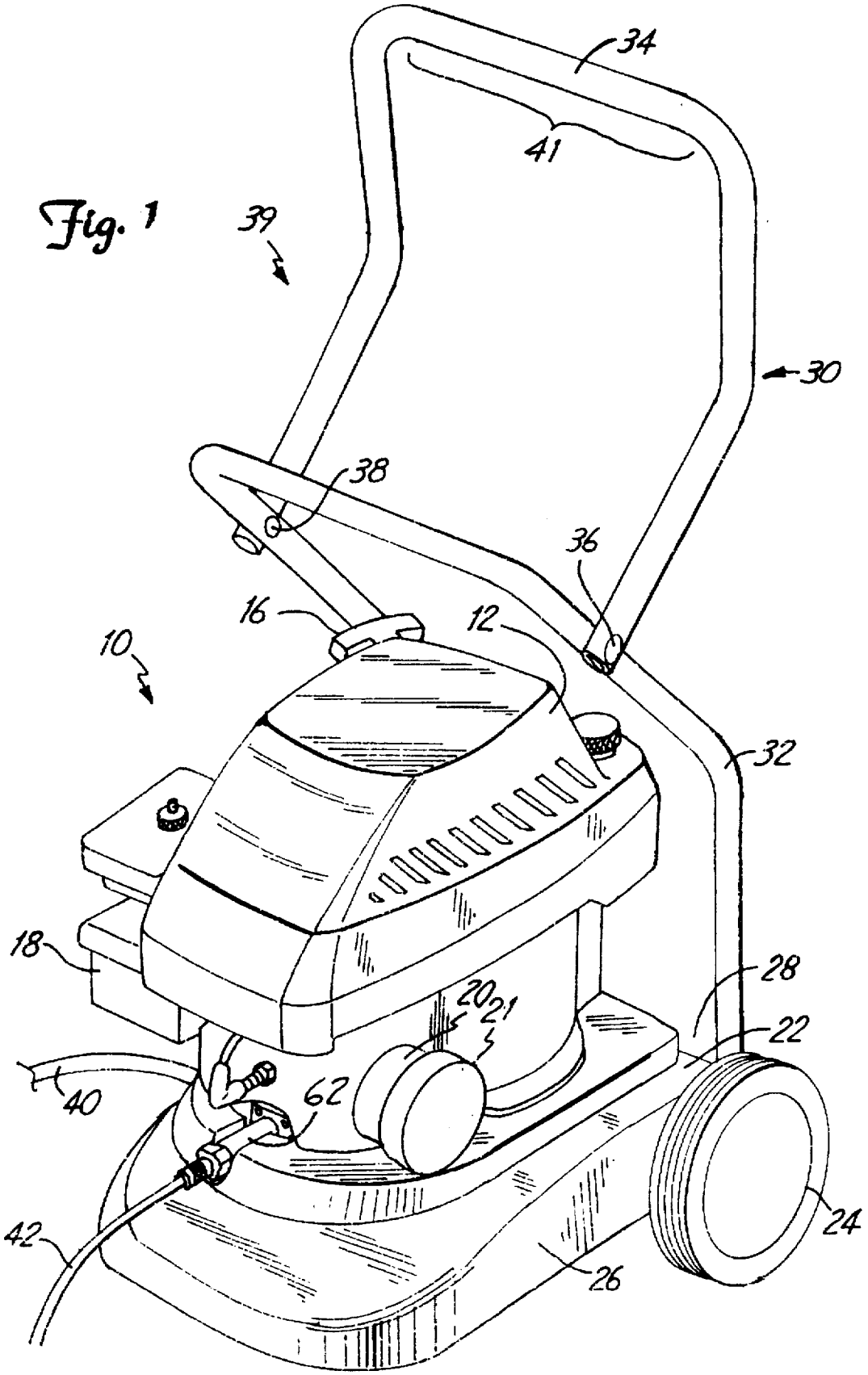
FIG. 1 is a perspective view of the low profile positive displacement pump of the present invention, driven by a gasoline powered engine.

FIG. 1 is a perspective view of a preferred embodiment of a low profile pressure washer 10 of the present invention, driven by a gasoline powered engine 12. The engine 12 is used to drive the pump 14 (shown in FIG. 2) of the present invention. Preferably, the engine includes a vertical rotational shaft 80 (shown in FIG. 2) which rotates at approximately 3400 revolutions per minute. Preferably, a 4 horsepower Briggs and Stratton model number 10A90 0505-01 engine is used. The preferred engine delivers approximately 2.1 gallons per minute of water at 1500 pounds per square inch when used with the preferred pump 14 of the present invention.

The engine 12 of the present invention includes a pull starter 16, a gasoline tank 18, an exhaust pipe 20 and a muffler 21. The engine 12 is preferably mounted directly onto a base 22. A wheel 24 is mounted on an axle (not shown) extending from the first side 26 of the base 22 to an opposite side 27 (shown in FIG. 3) near the rear end 28. A second wheel (not shown) is mounted to the opposite side 27 (shown in FIG. 3). The wheels 24 and axle are used in combination to transport the pressure washer 10.

Extending upwardly from the base 22 near the rear end 28 is a foldable handle 30. The handle 30 is provided to aid in transporting the pressure washer 10. The handle 30 has a lower inverted u-shaped member 32 and an upper inverted u-shaped member 34. The upper and lower u-shaped members are joined at pivotal connections 36, 38. Upper u-shaped member 34 can be pivoted about connections 36 and 38 and folded forwardly in a direction shown by arrow 39 until an uppermost portion 41 is positioned below the engine (not shown). The folding feature makes the device 10 more compact and more easily stored.

A water inlet line 40 to the pump 14 (shown in FIG. 2) and water outlet line 42 to the pump 14 (also shown in FIG. 2) is also provided. The water inlet 40 is preferably located on the side of the base 26 opposite the exhaust 20. Preferably, the water inlet 40 is equipped with a standard garden hose connector (not shown).

Figure 2:
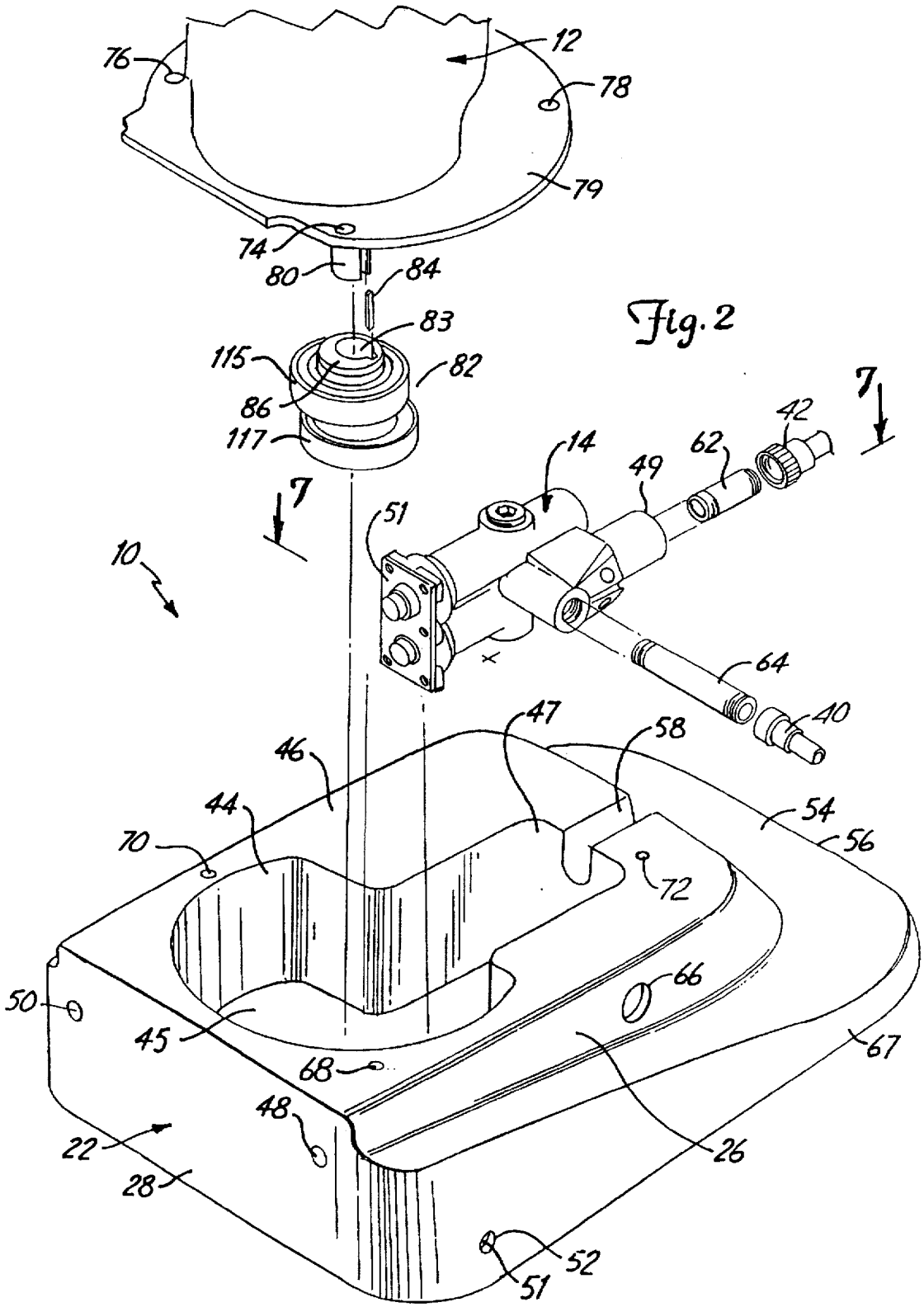
FIG. 2 is an exploded perspective view of a preferred embodiment of the present invention.

FIG. 2 is an exploded perspective view of a preferred embodiment of the present invention. The preferred base 22 includes a cavity 44 for receiving the pump 14. Preferably, the entire pump 14 is positioned beneath an upper surface 46 of the base 22 when the pump 14 is mounted in the cavity 44.

The bottom surface 45 of the cavity 44 supports a lower surface of the pump 14. Preferably, the pump 14 is bolted to the bottom surface 45. The cavity 44 also has a front vertical surface 47 which contacts an end 49 of the pump 14 opposite the driven end 51. The front vertical surface 47 prevents the pump 14 from moving horizontally when in operation.

The base 22 of the present invention includes a pair of openings 48 and 50 extending from the rear end surface 28 of the base into the body of the base 22. The openings are preferably cylindrical in shape. The openings 48 and 50 are provided for receiving the lower ends (not shown) of the lower u-shaped member 32 of the handle 30.

A bore 51 extending from the opening 52 in the side 26 to an opening on the opposite side (not shown) is each provided for receiving a wheel axle (not shown).

Preferably, the outer surface 54 of the pump base 22 is shaped for enhancing the appearance of the pressure washer 10. A u-shaped trough 58 in the front of the base 22 is provided for permitting the pump outlet fitting 62 to extend from the pump 14, through the base 22 to a point outside the base 22. Preferably, the trough 58 is cut deep enough so that an upper surface of the outlet fitting 62 is below the upper surface 46 of the base 22. An opening 66 extending from the cavity 44 to an outer surface 67 of the side portion 26 is provided for permitting the inlet fitting 64 to extend from the pump 14 through to the outside of the base 22.

In one embodiment of the present invention, the base is an injection molded plastic material. By fabricating the base using injection molding techniques, base 22 is physically strong and capable of maintaining the required positioning of elements. More specifically, base 22 is produced which has tight tolerances, thus aligning all elements appropriately. Furthermore, the base can be produced economically and efficiently.

Alternatively, the base unit will be made from a 20% glass fiber reinforced polypropylene. This material is believed to have a higher melt temperature and therefore is more durable and heat tolerant. This material will generally have a density of 64.9 lbs/ft$^3$, a tensile strength of 6,500 psi, a tensile elongation of 4% and a flexural strength of 10,000 psi. Additionally, the material will have a heat deflection temperature of 250° F. at 254 psi, or 285° F. at 60 psi.

Preferably, three mounting holes 68, 70 and 72 are drilled through the upper surface 46 of the pump base 22 and are positioned to align with mounting holes 74, 76 and 78, respectively on the mounting flange 79 of the engine 12. The engine 12 is preferably mounted directly to the base 22 by means of mounting bolts (not shown).

Figure 9:
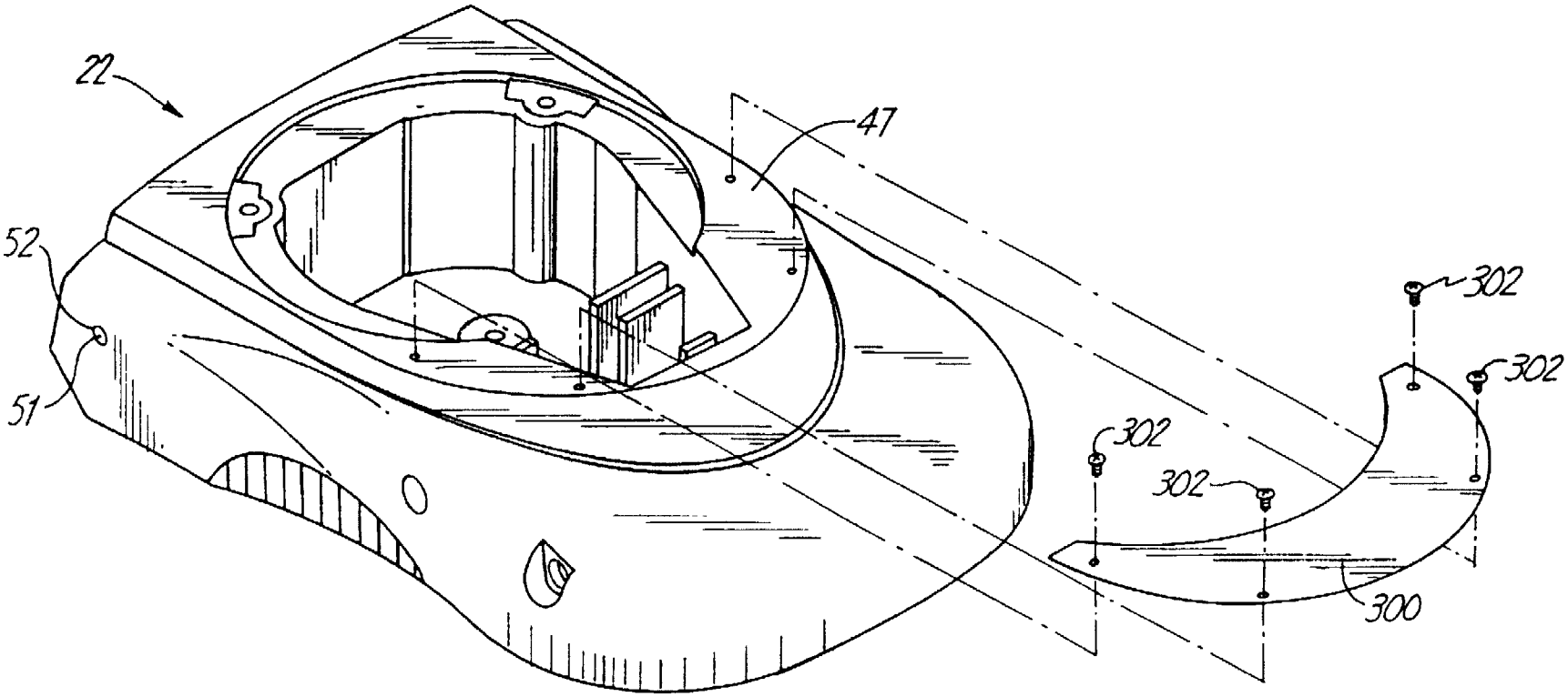
FIG. 9 is a perspective view of the pump base showing a heat deflecting shield attached thereto.

Referring now to FIG. 9, there is shown an additional feature of the present invention which allows base 22 to be fabricated out of injection molded fiberglass reinforced plastic. As would be expected, the use of gasoline powered engine 12 causes heat to be generated during operation of the pump. This heat could be detrimental to the body of base 22 when the base is made out of a plastic. To avoid any destructive effects, a heat deflecting shield 300 is attached to upper surface 46 of base 22. Heat deflecting shield 300 is attached to base 22 through the use of a plurality of attachment screws 302. Preferably, the heat deflecting shield 300 is constructed of 20 gauge steel and is coated with a protective coating for rust protection. In one embodiment of the invention this coating is black zinc. Preferably, the shield is in the form of a crescent and is positioned to deflect heat which leaks out between the exhaust manifold and the muffler.

The engine is preferably a 4 horsepower gas-powered engine having a vertically disposed rotational shaft 80. Preferably, the shaft 80 rotates at approximately 3400 r.p.m. A suitable engine is available by ordering model 10A90 0505-01 from Briggs and Stratton Company of Milwaukee, Wis.

While the preferred embodiment of the present invention includes the use of a gasoline powered engine to drive rotational shaft 80, it is understood that other power sources could be used. Specifically, the gas powered engine discussed above could easily be replaced by an electric motor such as a 1½ horsepower, 120 volt single phase motor. The output pressure of the resulting pump system, at about 2.5 gallons per minute would be reduced to about 1,000 psi, however.

Situations may exist where the use of a gasoline engine is impractical and the ability to easily adapt the invention to use an electric motor would be advantageous. Again, to take full advantage of the concepts of a low profile pump, an electric motor with a rotational shaft could easily be attached to base 22 such that the rotational shaft is appropriately aligned with pump 14. In this embodiment, as when using the gas engine, the alignment of the rotational shaft and pump 14 is attained by appropriate connection of the base 22 to an engine mounting flange.

The device of the present invention also includes a pump shaft assembly 82 which in the preferred embodiment is coupled directly to the shaft 80. The pump shaft assembly 82 includes a shaft 86 with a central bore 83 which engages an outer surface of the engine shaft 80. The mounting holes 68, 70 and 72, as well as the upper surface 46 align the pump shaft assembly 82 with the pump 14. A key 84 is provided to prevent rotation of the pump shaft assembly 82 with respect to the engine shaft 80. The details of the pump shaft assembly 82 are described in more detail below.

Figure 3:
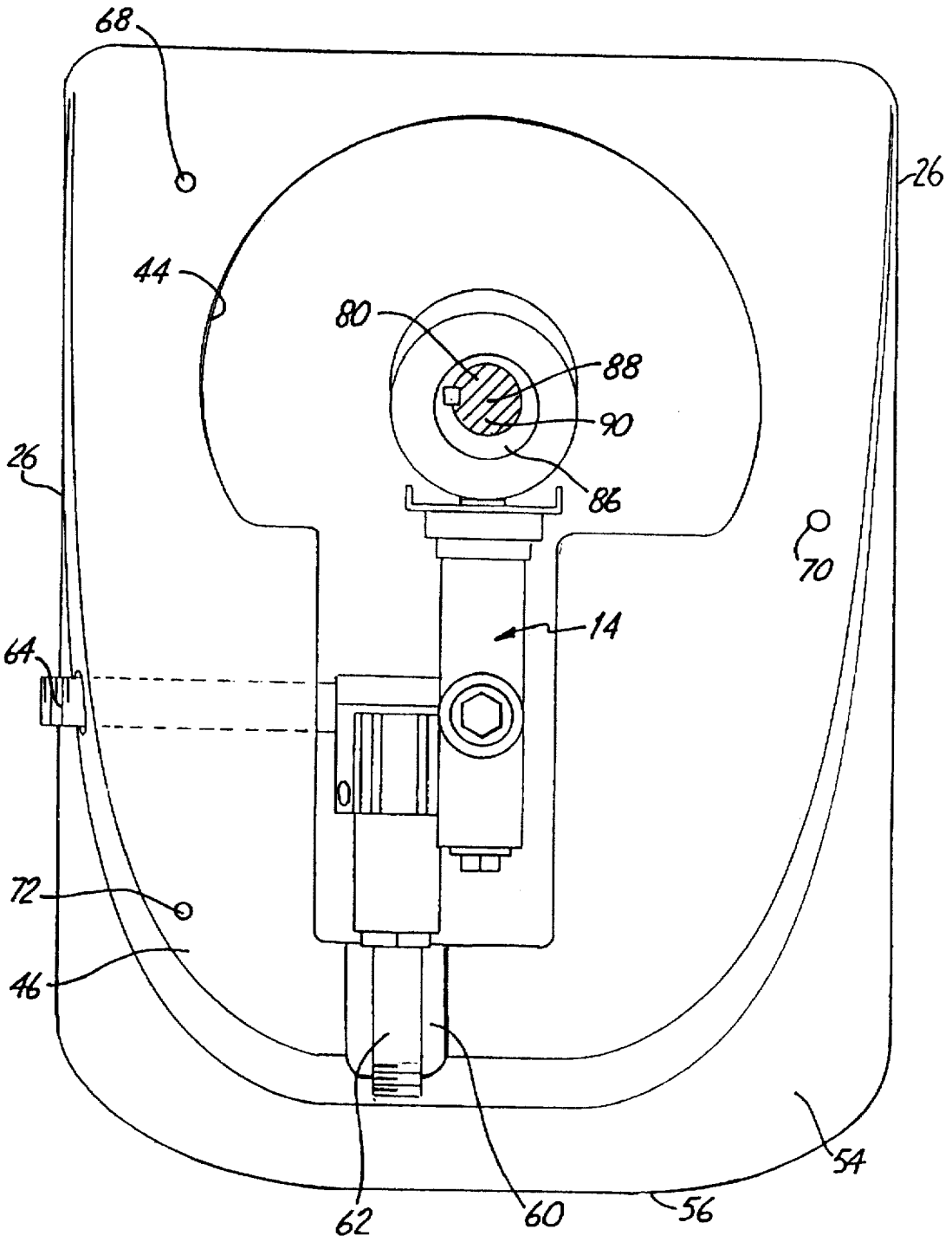
FIG. 3 is a top plan view of a preferred embodiment of the present invention, with the engine removed.

FIG. 3 is a top plan view of the device of the present invention, with the engine removed. The engine shaft 80 preferably has a central rotational axis 88 (into the paper) which is offset from a central rotational axis 90 (into the paper) of the pump shaft 86.

Figure 4:
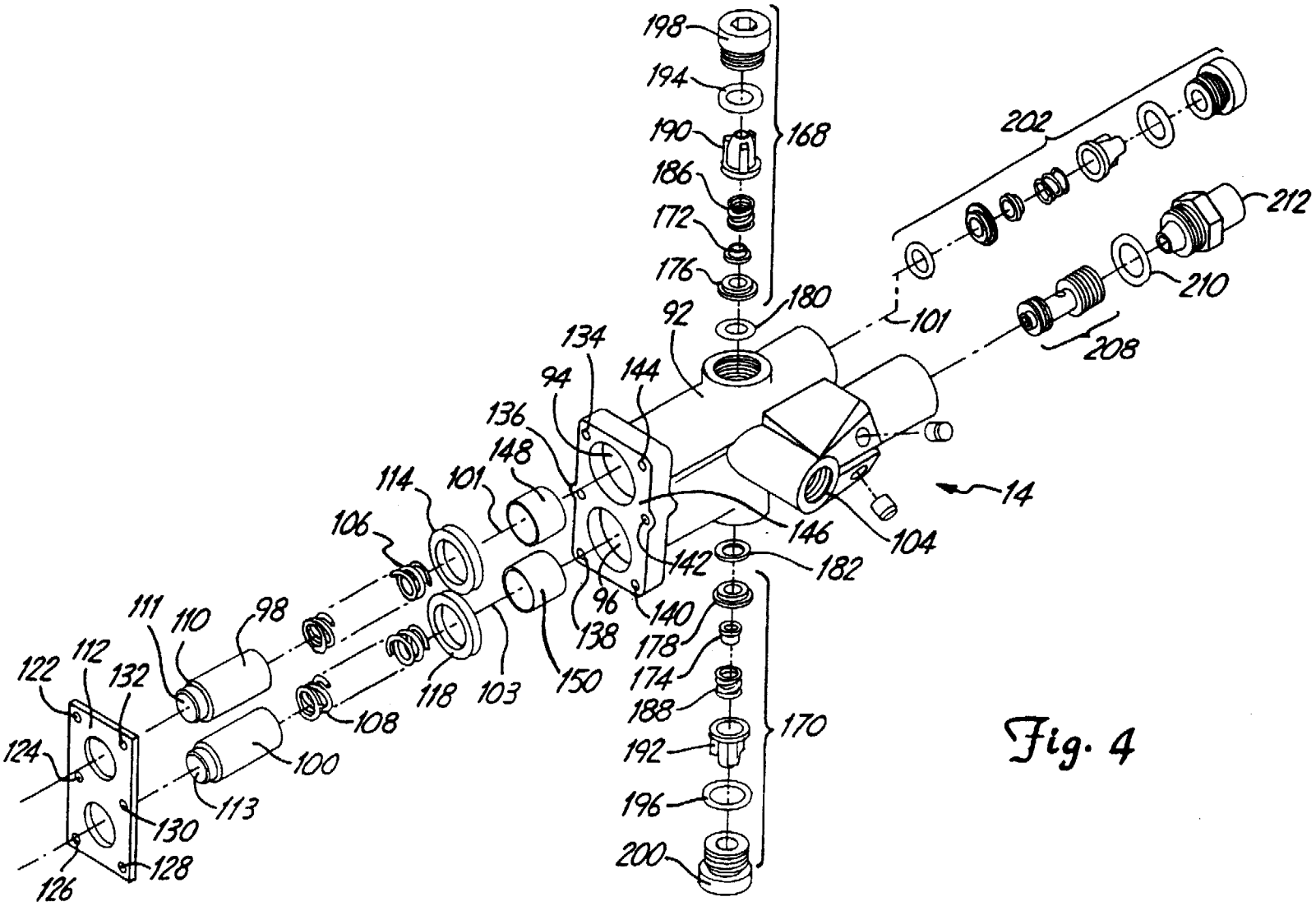
FIG. 4 is an exploded perspective view of the positive displacement pump of the present invention.

FIG. 4 is an exploded perspective view of the pump 14 of the present invention. The pump 14 of the present invention is preferably a twin piston positive displacement pump. Each piston travels horizontally. The travel of each piston from an original position, inwardly, then outwardly, returning to its original position for purposes of this disclosure is hereinafter referred to as a "stroke." The first piston is positioned directly over the second piston. The preferred pump has a relatively short vertical distance and has a low profile. The preferred pump 14 is advantageously driven by a downwardly extending rotational engine shaft 88 (shown in FIGS. 2 and 3).

The pump 14 includes a pump body 92 which preferably is constructed of die cast aluminum. The aluminum construction is desirable because it possesses adequate strength characteristics, is light and it is low in cost. The body 92 can also be constructed of injection molded plastic. The aluminum body is more preferred because the performance characteristics of the aluminum are superior to the characteristics of known plastic compounds.

The pump body 92 includes an upper horizontal bore 94 and a lower horizontal bore 96 for receiving reciprocating plungers 98 and 100, respectively. It is to be understood that the second plunger 100 is substantially identical in operation, except that the motion of the second plunger 100 is 180 degrees out of phase from the motion of the first plunger 98. What is meant by "out of phase" is that when plunger 98 is fully extended, plunger 100 is fully retracted. Also, the direction of motion of each plunger 98 and 100 is opposite during operation.

Figure 7:
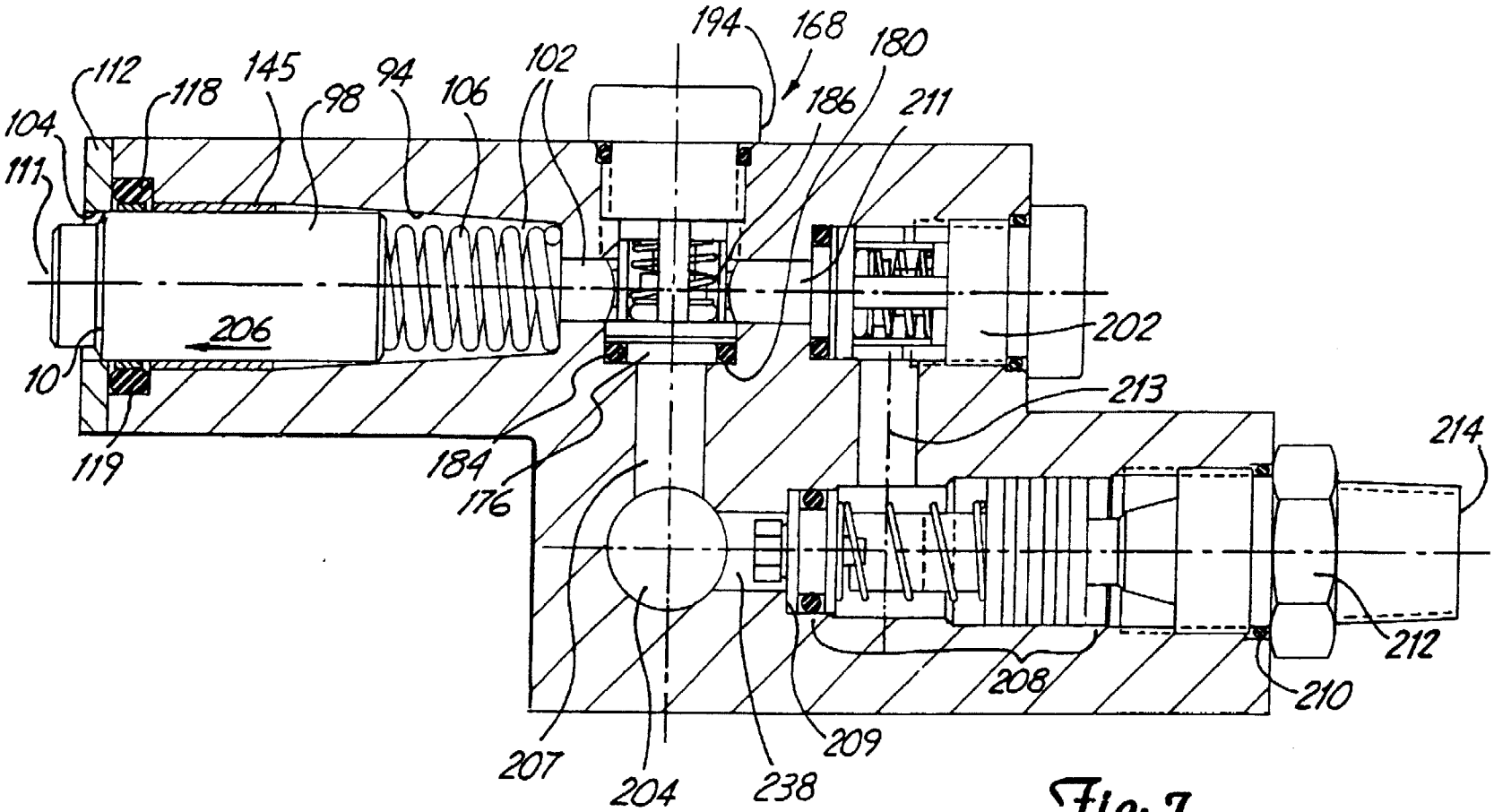
FIG. 7 is a cross-sectional view of the pump taken along line 7—7 as shown in FIG. 2.

Each bore 94 and 96 is substantially cylindrical and is open at a wet end 102 as well as a driven end 104 (both shown in FIG. 7). Springs 106 and 108 are positioned within the bores 94 and 96, respectively, and are provided for biasing ends 111, 113 of plungers 98 and 100 against eccentric surfaces 115, 117 (shown in FIG. 2) of the pump shaft assembly 82. High pressure seals 114, 118 are provided for preventing liquid from passing from the wet end 102 (shown in FIG. 7) out the driven end 104. Each high pressure seal 114 and 118 is retained in a seal seat 119 (shown in FIG. 7—the other seat is not shown) by seal retainer 112. Preferably, seal retainer 112 is substantially flat and has six openings 122, 124, 126, 128, 130 and 132 which align with openings 134, 136, 138, 140, 142 and 144 of the pump housing. Bolts (not shown) secure the seal retainer 112 tightly against the mounting bracket 146 of the pump housing.

Linear bearings 148, 150 are mounted in upper bore 94 and lower bore 96, respectively. Each bearing contacts both an inner surface of the bore 94, 96 and an outer surface of plungers 98 and 100. The bearings reduce friction between the bore 94 and plunger 98 and improve the pumping efficiency. The bearings advantageously have brought the efficiency of the preferred pump from about 85 percent efficiency to about 98 percent efficiency.

Figure 5:
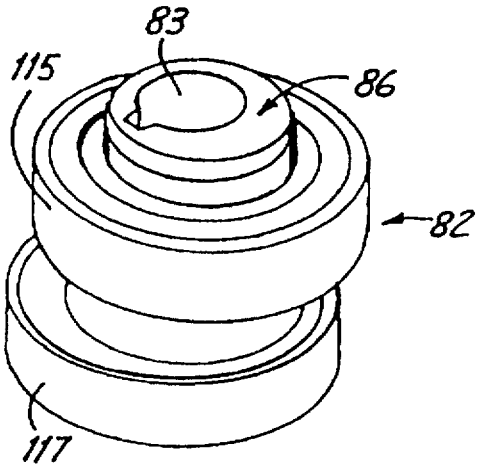
FIG. 5 is a perspective view of the pump shaft assembly of a preferred embodiment of the present invention.

FIG. 5 is a perspective view of the pump shaft assembly 82 of a preferred embodiment of the present invention. The pump shaft assembly 82 mounts directly onto the drive shaft 80 of the engine 12 (shown in FIG. 2). In operation, the eccentric surfaces 115 and 117 are positioned against plunger ends 111 and 113 (shown in FIG. 4), respectively. Eccentric surfaces 115 and 117 are positioned such that plungers 98 and 100 operate 180 degrees out of phase.

Figure 6:
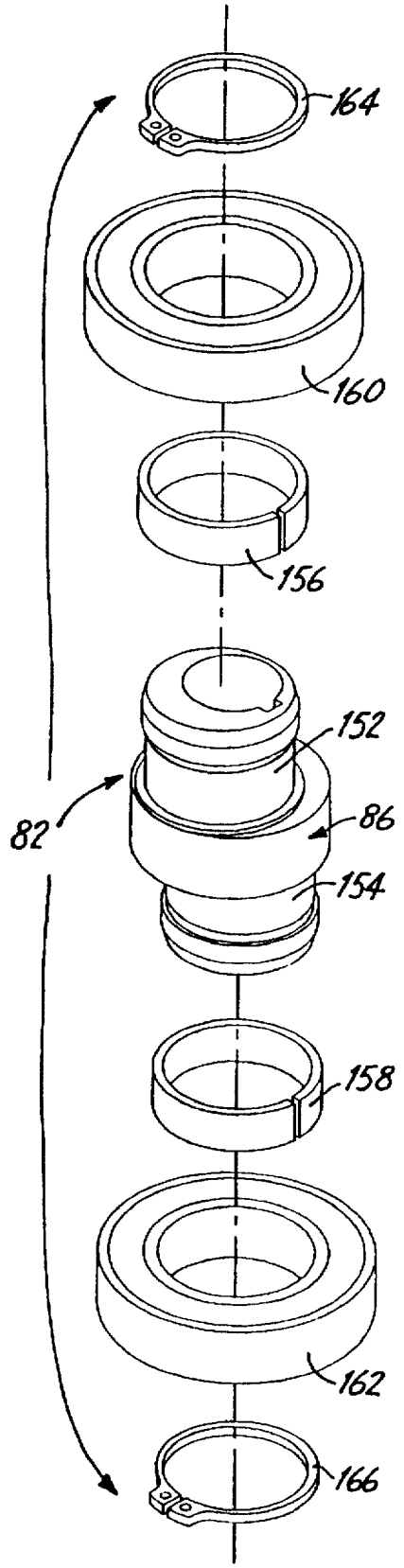
FIG. 6 is an exploded perspective view of the preferred pump shaft assembly of the present invention.

FIG. 6 is an exploded perspective view of the preferred pump shaft assembly 82 of the present invention. Preferably, the pump shaft 86 has a first bearing contact surface 152 and a second bearing contact surface 154. Tolerance rings 156 and 158 are mounted to the contact surfaces 152 and 154. Preferably, mounted onto tolerance rings 156 and 158 are bearings 160, 162 which are provided to reduce drag between eccentric surfaces 115, 117 and plunger ends 111 and 113. Retaining rings 164 and 166 are provided to hold each bearing 160 and 162 onto the shaft 86.

The preferred base 22 as shown in FIG. 2 advantageously supports the engine 12 as well as fixing the relative position of the eccentric surfaces 115 and 117 with respect to the ends 111 and 113 of the plunger. Alignment holes 68, 70 and 72, as well as upper surface 46 advantageously align the shaft assembly 82 with plungers 98 and 100 of the pump 14.

Referring back to FIG. 4, the structure of the pump 14 will be further described. Inlet valve assemblies 168 and 170 are provided which function as check valves during the operation of the pump. Each valve has a valve disc 172, 174 which rests in a retainer 176, 178 which include valve seats (not shown). O-rings 180, 182 are positioned between the first valve receiving surface 184 (shown in FIG. 7) and the second valve receiving surface (not shown), and the retainers 176, 178 (shown in FIG. 7). Springs 186, 188 are provided for forcing the valve seat into the closed position during the discharge stroke.

Spring retainers 190, 192 are provided for holding the springs 186, 188 against valve discs 172, 174, respectively. O-rings 194, 196 are provided and are positioned between valve caps 198 and 200, and retainers 176, 178 respectively. Discharge check valves 202 (second valve not shown) of identical construction are also mounted into the housing and are located opposite each piston 98, 100 along the piston axes 101, 103.

The operation of the pump can best be understood by referring to FIG. 7. FIG. 7 is a cross-sectional view of the pump taken along line 7—7 as shown in FIG. 2. The water inlet 204 feeds both the wet end 102 of the upper bore 94 and the lower bore 96. Eccentric surface 115 (shown in FIG. 5) contacts the end 111 of plunger 98. As the shaft 86 rotates, the eccentric surface 115 releases a force applied to the end 111 of the plunger 98, allowing the spring 106 to move the plunger 98 in a direction represented by arrow 206. The inlet check valve 168 opens, allowing water to pass through channel 207, into the upper bore 94. The outlet check valve 202 remains in a closed position for the duration of the inlet stroke.

As the shaft 86 rotates, eccentric surface 115 begins to move the piston 98 in a direction opposite that shown by arrow 206. The inlet check valve 168 then closes, the outlet check valve 202 opens, and water is sent through channel 211, through valve 202 and through channel 213 to an unloader valve assembly 208. Preferably, both upper bore 94 and lower bore 96 are fluidly connected so that only one unloader valve assembly is needed.

The unloader valve assembly 208 as shown in either FIG. 4 or FIG. 7 is held against the valve receiving surface 209 by means of an O-ring 210 and a valve cap 212. The unloader valve assembly diverts water to the outlet 214 until the fluid temperature within the assembly reaches a preselected temperature of approximately 140 degrees F. When the selected temperature is exceeded, the valve will divert the water back into the inlet 204 to avoid applying too much internal pressure to the pump body 92.

The outlet 214 is equipped with a standard high pressure hose connector for coupling to a high pressure hose (not shown).

Figure 8:
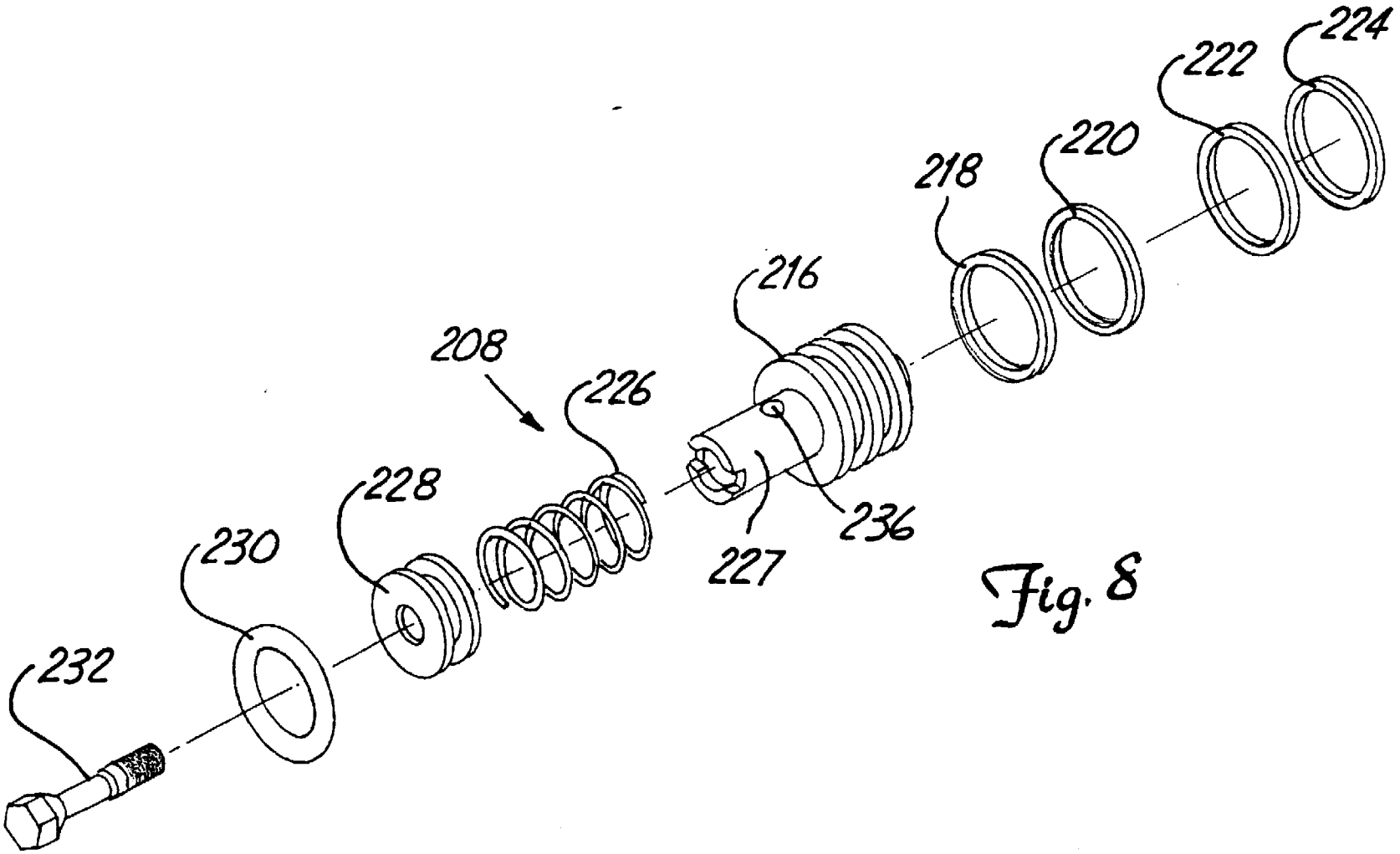
FIG. 8 is an exploded perspective view of a preferred unloader cartridge assembly of the present invention.

The structure of the unloader valve assembly can be better understood by referring now to FIG. 8. FIG. 8 is an exploded perspective view of a preferred unloader cartridge assembly of the present invention. The unloader valve assembly 208 includes a piston 216 and four piston rings 218, 220, 222 and 224 which are preferably formed of polytetrafouroethelyne, or PTFE plastic. A spring 226 is mounted onto the shaft portion 227 of the piston 216 which applies a force against valve seat 228. O-ring 230 is positioned between valve 232 and seat 228.

In operation, water travels into the cavity 238 as best shown in FIG. 7. The water enters into a central bore of the piston 216 by means of opening 236 (shown in FIG. 8) and travels through a venturi (not shown), causing a pressure drop. As long as the pressure differential is present, the water travels through the valve and out the outlet 214. When the outlet 214 is blocked, the pressure differential in the valve disappears, and the water is diverted through channel 238 and back into the inlet 204. This type of unloader valve 208 is particularly useful in connection with a water gun of the type known in the pressure washer industry.

The device of the present invention is lighter in weight than known gas-powered pressure washers, has a more compact overall shape, and is less expensive than known gas-powered high pressure pumps. The cost of the device of the present invention is lower than known devices because the crank case between the drive shaft and the pistons is eliminated. The pumping system of the present invention is also easily movable and portable.

Although the present invention has been described with reference to the preferred embodiments, workers skilled in the art will recognize that changes may be made in form and detail without departing from the spirit and scope of the invention.

What is claimed is:

1. A low profile positive displacement pump, suitable for being driven by a gasoline powered engine with a rotational shaft on a first axis, comprising:

a pump housing including a fluid inlet, a fluid outlet and at least one bore fluidly connected to the fluid inlet and outlet for receiving a plunger;

at least one plunger, each plunger positioned in the bore for reciprocating movement, each plunger having a driven end and located on an axis perpendicular to the rotational shaft axis;

a base including a cavity for retaining the pump housing having connecting means for mounting an engine directly to the pump housing;

a heat deflecting shield attached to the base and positioned adjacent to the engine for deflecting heat produced by the engine away from the base;

a rotational pump shaft adapted for coupling to an engine shaft, the pump shaft having a central rotational axis parallel to the rotational shaft axis;

at least one eccentric camming surface on the pump shaft for contacting the driven end of the plunger and for causing the plunger to move in a first direction perpendicular to the central axis of the pump shaft;

a spring positioned in the bore for causing the plunger to move in a second direction opposite the first direction;

at least one inlet check valve mounted in the pump housing and fluidly connected to the fluid inlet;

at least one outlet check valve mounted in the pump housing and fluidly connected to the fluid outlet; and an unloader valve mounted in the pump housing and fluidly connected to the fluid outlet and fluid inlet; and wherein the base is adapted for mounting directly to a mounting flange of a gasoline powered engine and wherein the base fixes the position of each eccentric camming surface with respect to each driven end.

2. The displacement pump of claim 1 wherein the heat deflection shield is positioned adjacent the engine such that it is positioned to deflect exhaust gasses escaping from between an exhaust manifold and muffler.

3. The displacement pump of claim 1 wherein the heat deflection shield is a metal plate coated with a corrosion inhibiting material.

4. The displacement pump of claim 3 wherein the corrosion inhibiting material is a black zinc.

5. The displacement pump of claim 2 wherein the deflection shield is crescent shaped.

6. A high pressure piston pump base, comprising:

a main body including an upper surface, wherein the upper surface is suitable for coupling to a mounting flange of a gasoline powered engine;

a heat deflecting means attached to the main body for deflecting heat produced by the engine away from the pump base; and a central cavity being of a size and shape suitable for retaining a high pressure pump, wherein the cavity is of a size and shape suitable for supporting the pump.

7. The pump base of claim 6 wherein the heat deflecting means is positioned adjacent the engine such that it is positioned to deflect exhaust gasses escaping from between an exhaust manifold and muffler.

8. The pump base of claim 6 wherein the heat deflection means is a metal plate coated with a corrosion inhibiting material.

9. The pump base of claim 8 wherein the corrosion inhibiting material is a black zinc.

10. The pump base of claim 8 wherein the deflection shield is crescent shaped.

11. The pump base of claim 6 wherein the base is fabricated out of an injection molded plastic material.

12. The pump base of claim 11 wherein the plastic material is a 20% glass fiber reinforced, medium impact polypropylene.

13. A low profile positive displacement pumping system comprising:

a gasoline powered engine with a rotational drive shaft and a mounting flange;

a positive displacement pump having at least one reciprocating piston with a driven end, the piston being disposed such that a central piston axis is perpendicular to the rotational drive shaft;

at least one eccentric surface fixed to the drive shaft, wherein the eccentric surface is in contact with a bearing which is in contact with the driven end, and wherein each revolution of the shaft causes each piston to complete a stroke; and a base including an upper surface, a heat deflecting shield and a cavity located beneath the upper surface suitable for supporting the pump, wherein the mounting flange of the engine bolts directly onto the base, and wherein the base aligns each eccentric surface with each driven end, and wherein the heat deflecting shield is situated adjacent to the engine when the engine is bolted directly onto the base.

14. The device of claim 13, wherein the pump is a twin piston pump, and further comprising a pump shaft assembly, the assembly comprising:

a pump shaft having a bore for receiving the drive shaft, and an outer surface, the outer surface including two eccentric surfaces for receiving bearings; and a bearing mounted onto each eccentric surface, wherein each bearing has an outer surface which contacts the driven end of a piston.

15. A low profile positive displacement pumping system comprising:

a power source with a rotational drive shaft and a mounting flange;

a positive displacement pump having at least one reciprocating piston with a driven end, the piston being disposed such that a central cylindrical axis of the piston is perpendicular to the rotational drive shaft;

at least one eccentric surface fixed to the drive shaft, wherein the eccentric surface is in contact with the driven end or with a bearing mounted on the eccentric surface, and wherein each revolution of the shaft causes each piston to complete a stroke; and a base including an upper surface, a cavity located beneath the upper surface suitable for supporting the pump, wherein the mounting flange of the power source bolts directly onto the base, and wherein the base aligns each eccentric surface with each driven end.

16. The device of claim 15, wherein the pump is a twin piston pump, and further comprising a pump shaft assembly, the assembly comprising:

a pump shaft having a bore for receiving the drive shaft, and an outer surface, the outer surface including two eccentric surfaces for receiving a bearing; and a bearing mounted onto each eccentric surface, wherein each bearing has an outer surface which contacts the driven end of a piston.

17. The device of claim 15 wherein the power source is a gasoline powered engine.

18. The device of claim 15 wherein the power source is an electric motor.

* * * * *

UNITED STATES PATENT AND TRADEMARK OFFICE

CERTIFICATE OF CORRECTION

PATENT NO. : 5,700,137

DATED : December 23, 1997

INVENTOR(S) : Dallas W. Simonette

It is certified that error appears in the above-indentified patent and that said Letters Patent is hereby corrected as shown below:

On the title page, item [54] and col. 1, after "SYSTEM", add --WITH HEAT DEFLECTING MEANS--.

Col. 8, line 54, delete "deflection" and insert therefor --deflecting--.

Signed and Sealed this

Fifth Day of May, 1998

*Attest:*

*Attesting Officer*

BRUCE LEHMAN

*Commissioner of Patents and Trademarks*